US005927701A

United States Patent [19]

Chapman

[11] Patent Number: 5,927,701

[45] Date of Patent: Jul. 27, 1999

[54] FOOD HOLDER FOR ITEMS TO BE SLICED

[75] Inventor: Dean Chapman, Brooklyn, N.Y.

[73] Assignee: General Housewares Corp., Terre Haute, Ind.

[21] Appl. No.: 08/989,049

[22] Filed: Dec. 11, 1997

[51] Int. Cl.[6] ..... B26D 7/02

[52] U.S. Cl. ..... 269/87.2; 269/295

[58] Field of Search ..... 269/87.2, 288, 269/291, 257, 295, 289 R, 239, 287, 6; 83/762, 454, 932

[56] References Cited

U.S. PATENT DOCUMENTS

| | | | |
|---|---|---|---|
| D. 277,066 | 1/1985 | Levine . | |
| D. 277,445 | 2/1985 | Levine . | |
| D. 279,156 | 6/1985 | Levine . | |
| D. 315,275 | 3/1991 | Aziz et al. . | |
| D. 316,657 | 5/1991 | Mulherin . | |
| D. 330,315 | 10/1992 | Shved . | |
| D. 343,770 | 2/1994 | McFarling et al. . | |
| D. 354,203 | 1/1995 | Naccarato . | |
| D. 371,722 | 7/1996 | Chao . | |
| D. 371,728 | 7/1996 | Krueger . | |
| 1,878,850 | 9/1932 | Hilgers | 269/257 |
| 2,685,901 | 8/1954 | Putzer . | |
| 4,125,046 | 11/1978 | Kroh et al. | 269/295 |
| 4,140,340 | 2/1979 | Cloutier | 269/291 |
| 4,249,445 | 2/1981 | Browning . | |
| 4,399,989 | 8/1983 | Baillie . | |
| 4,546,686 | 10/1985 | Losiowski et al. . | |
| 4,550,636 | 11/1985 | Josselson et al. . | |
| 4,747,331 | 5/1988 | Policella . | |
| 4,807,505 | 2/1989 | Campbell et al. . | |
| 4,807,862 | 2/1989 | Popeil et al. | 269/87.2 |
| 4,865,302 | 9/1989 | Armstrong | 269/288 |
| 4,948,106 | 8/1990 | Popeil et al. . | |
| 5,033,193 | 7/1991 | Valenti . | |
| 5,228,668 | 7/1993 | Guyer . | |
| 5,361,666 | 11/1994 | Kensrue . | |
| 5,386,755 | 2/1995 | Schneider et al. . | |
| 5,431,078 | 7/1995 | Ricard et al. . | |
| 5,481,953 | 1/1996 | McLeod . | |
| 5,697,276 | 12/1997 | Nassau | 269/291 |

*Primary Examiner*—David A. Scherbel
*Assistant Examiner*—Lee Wilson
*Attorney, Agent, or Firm*—Emrich & Dithmar

[57] ABSTRACT

A holder for containing items to be sliced is provided. The holder includes a base, a first sidewall having a proximal end fixedly secured to the base and a distal end, and a second sidewall having a proximal end fixedly secured to the base and a distal end. The sidewalls have a normal rest position wherein the distal ends are spaced apart a predetermined distance. At least one of the sidewalls is formed of a flexible and resilient material and is deflectable from the rest position in a direction which increases the distance between the distal ends.

20 Claims, 8 Drawing Sheets

24
74
75
124
26
22
50
F
122

FOOD HOLDER FOR ITEMS TO BE SLICED

BACKGROUND OF THE INVENTION

1. Field of the Invention

This invention relates to food holders, and more particularly to holders for containing food items to be sliced.

2. Description of the Prior Art

In the past, most holders for food items to be sliced included two sidewalls forming a compartment for the item to be sliced. These holders required the user to force one of the sidewalls toward the other to grip the item between the sidewalls, thus making the holder awkward and often unsafe to use. Additionally, these holders were often made of complicated and expensive structure.

Other prior art holders, while not built of complicated structure were often unsafe. Some were built with fixed sidewalls with a knife slot therebetween and no handles. This was an unsafe construction because it often required a user to grasp both sidewalls with one hand often causing the user's grasping hand to be in close proximity to the slicing knife.

SUMMARY OF THE INVENTION

It is a general object of the invention to provide an improved holder for items to be sliced which avoids the disadvantages of prior holders while affording additional structural and operating advantages.

An important feature of the invention is the provision of a holder which is of simple and economical construction.

A further feature of the invention is the provision of a holder of the type set forth which is safe to use.

In connection with the foregoing feature, a further feature of the invention is the provision of a holder of the type set forth which includes a sidewall having a hand hold which facilitates a safe grasping position away from the knife used to slice the food item.

In connection with the foregoing features, a further feature of the invention is the provision of a holder of the type set forth which includes a non-slip base.

A still further feature of the invention is the provision of a holder of the type set forth, which has one or more flexible sidewalls to form a compartment to accommodate and firmly grip various sized food items to be sliced.

Certain ones of these and other features of the invention may be attained by providing a holder for containing items to be sliced which includes a base, a first sidewall having a proximal end fixedly secured to the base and a distal end and a second sidewall having a proximal end fixedly secured to the base and a distal end. The sidewalls have a normal rest position wherein the distal ends are spaced apart a predetermined distance. At least one of the sidewalls is formed of a flexible and resilient material and is deflectable from the rest position in a direction which increases the distance between the distal ends.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
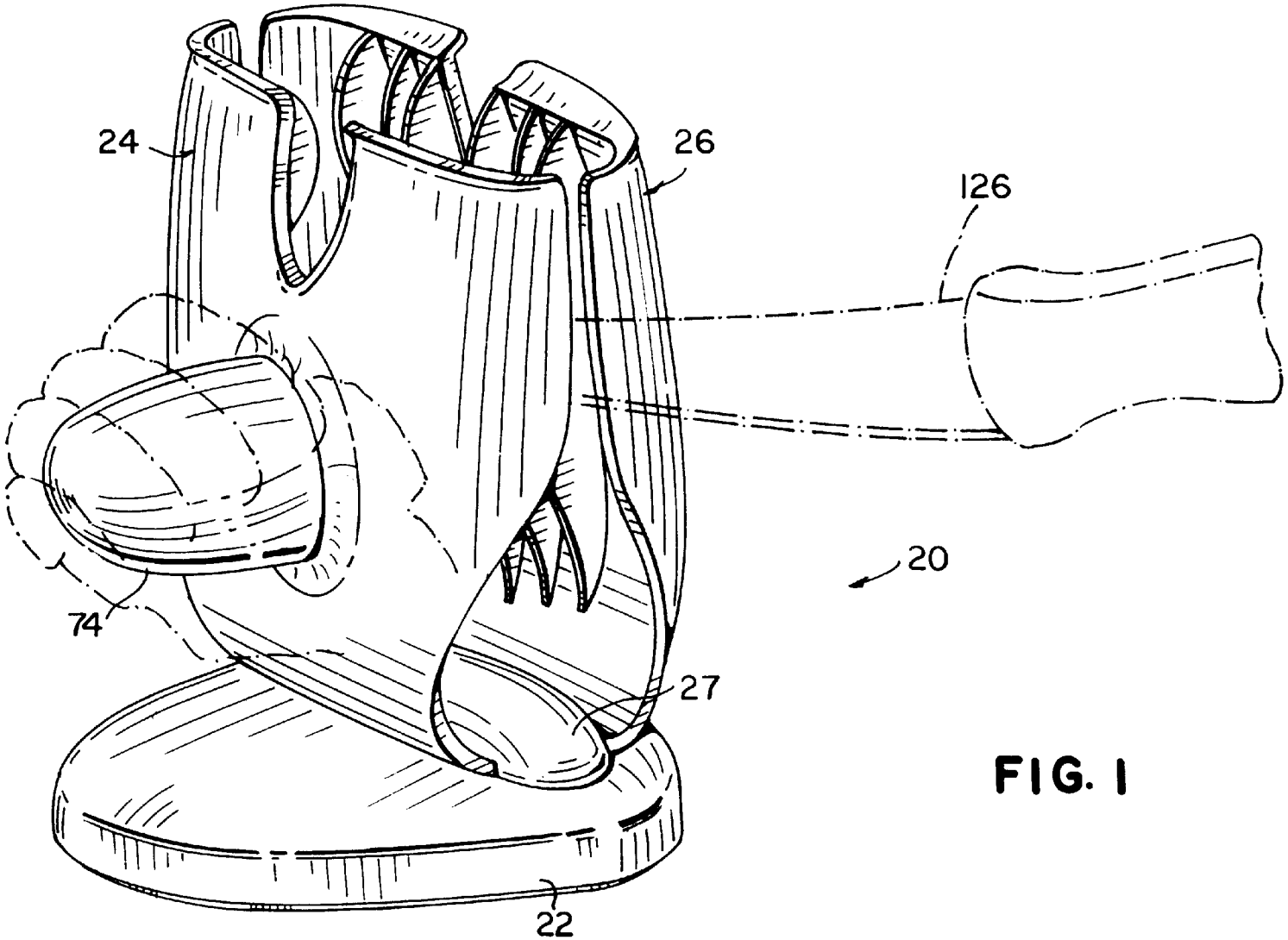
FIG. 1 is a perspective view of the holder of the present invention.

Referring to the drawings, a holder 20, such as a bagel holder, for holding items to be sliced is illustrated. The holder 20 includes a base 22, a first sidewall 24, a second sidewall 26 and a cut mat 27.

Figure 2:
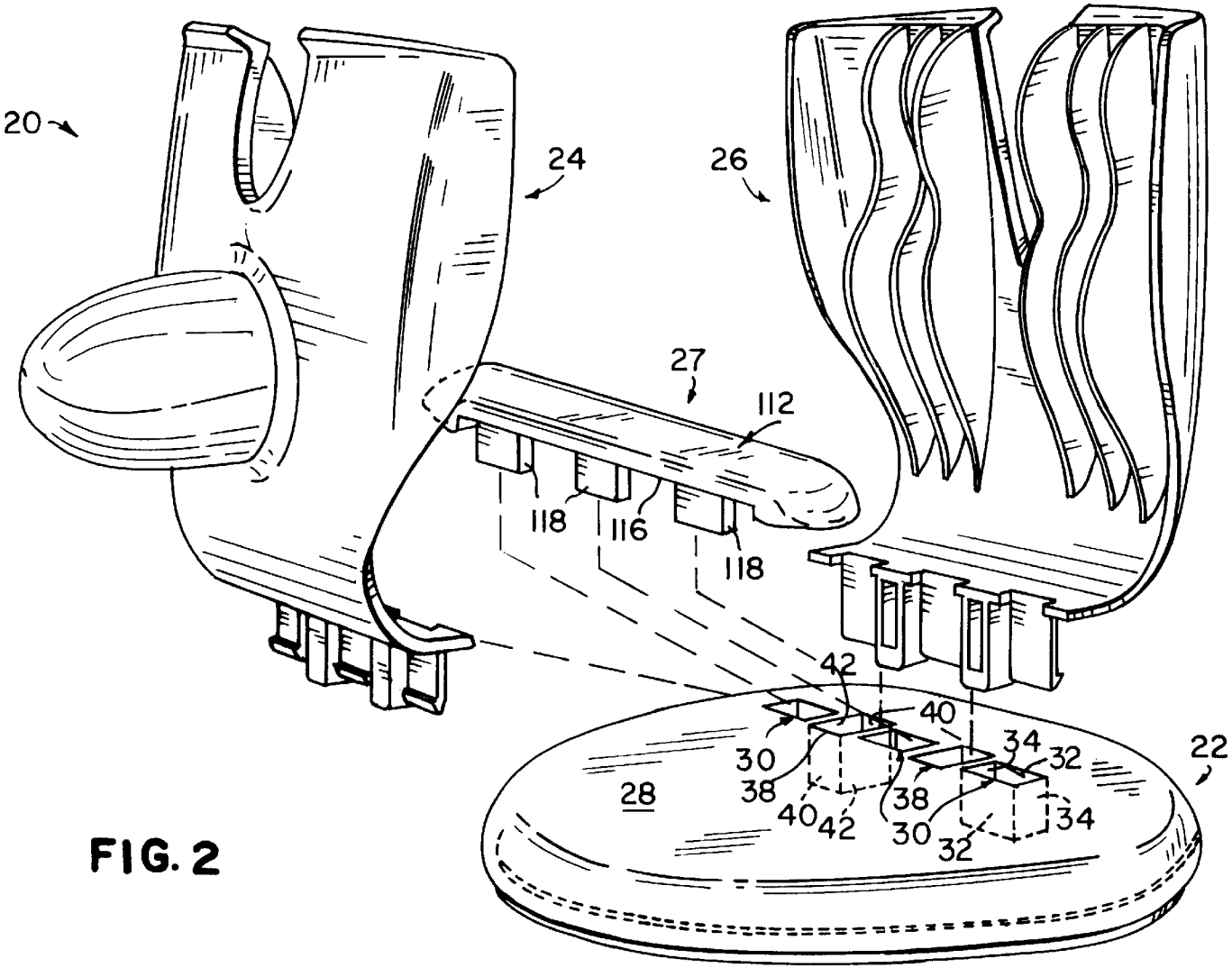
FIG. 2 is an exploded perspective view of the holder of FIG. 1.
Figure 4:
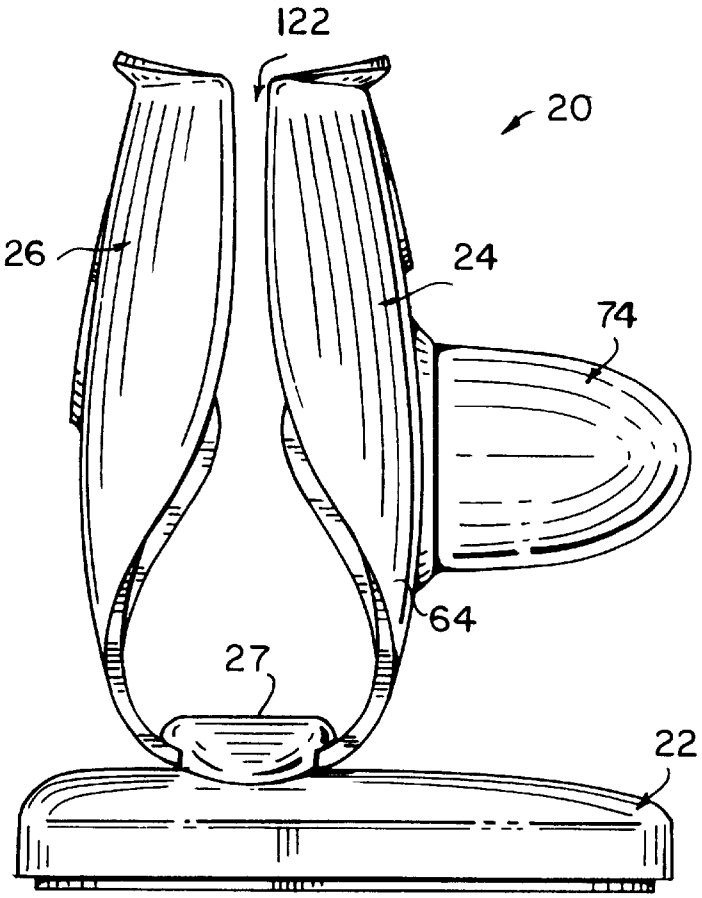
FIG. 4 is a side elevation view of the holder of FIG. 1, as viewed from the left-hand side thereof.
Figure 3:
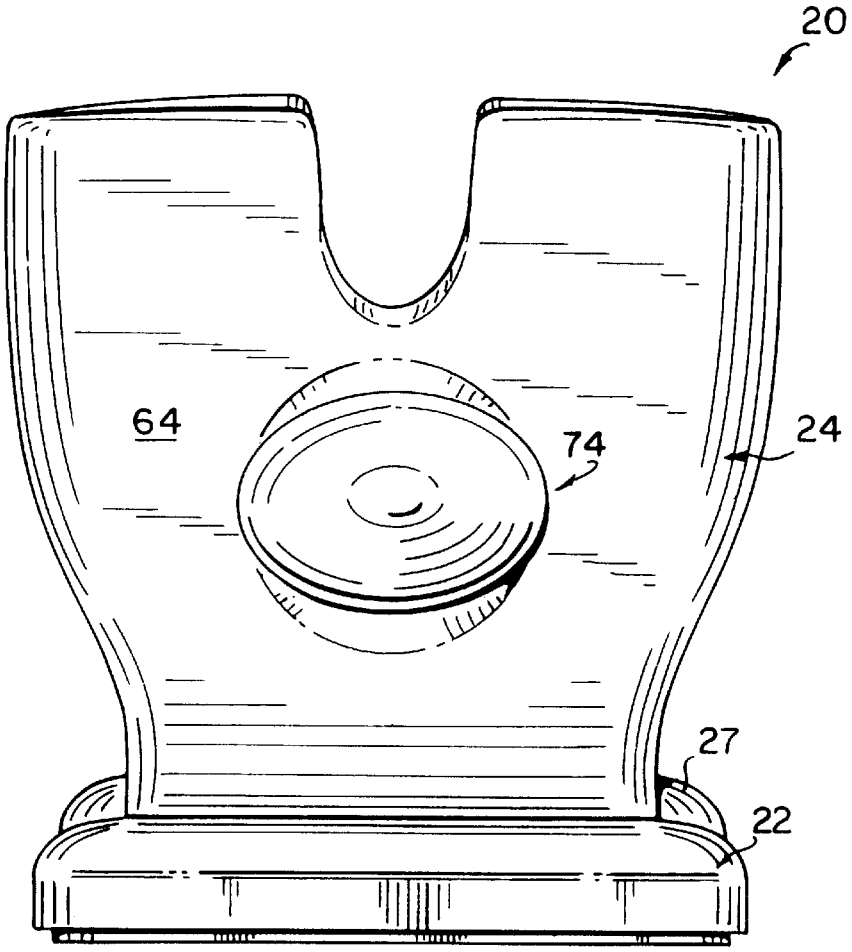
FIG. 3 is a front elevation view of the holder of FIG. 1.

The base 22, can be molded and made of a plastic material, such as acrylonitrile butadiene styrene ("ABS"), and, as best seen in FIG. 2, includes an upper portion 28, having three locking apertures 30 therein, each formed by two sets of parallel walls 32, 34 depending from the upper portion 28 of the base 22. As seen in FIG. 1, the bottom of each of the walls 32 forms a shoulder surface 36.

Figure 11:
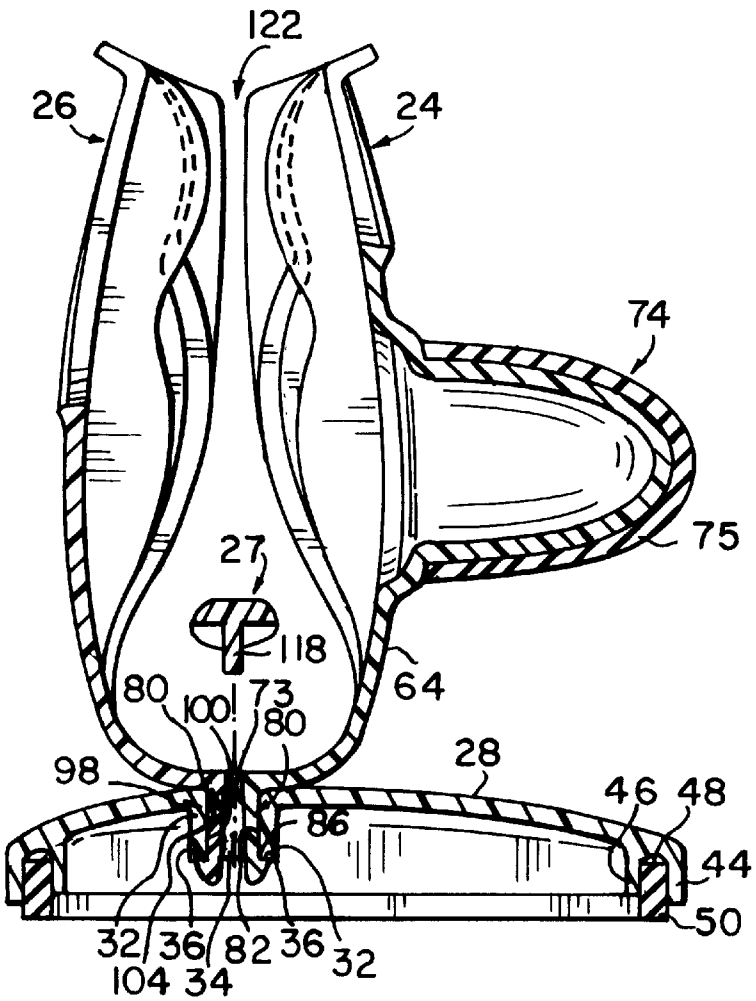
FIG. 11 is a sectional view taken generally along the line 11—11 of FIG. 6.

The base 22, as seen in FIGS. 2 and 11, also includes two peg apertures 38 each formed of two sets of parallel walls 40, 42 depending from the upper portion 28 of the base 22.

Figure 6:
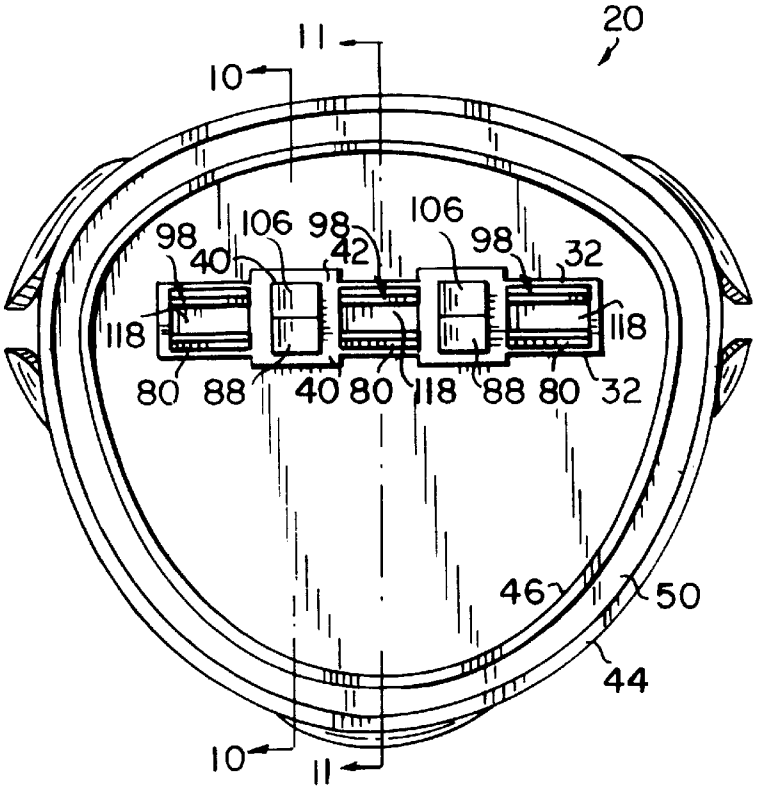
FIG. 6 is a bottom plan view of the holder of FIG. 1.
Figure 10:
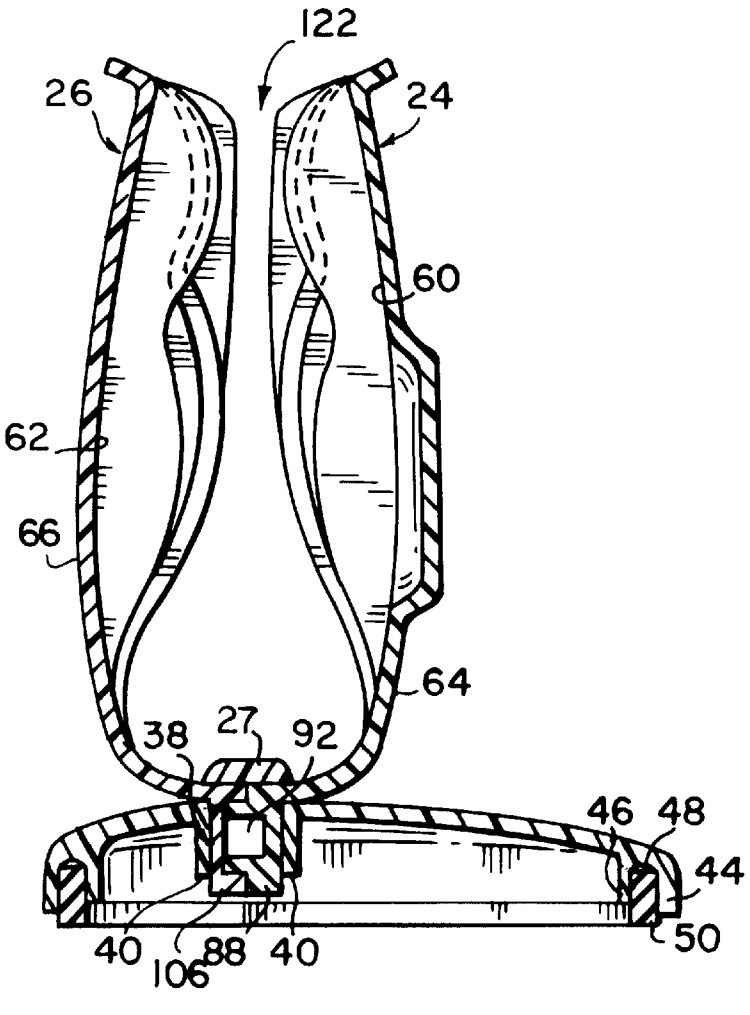
FIG. 10 is a sectional view taken generally along the line 10—10 of FIG. 6.

The base 22 further includes, as seen in FIGS. 6, 10 and 11, an outer peripheral wall 44 depending from the upper portion 28, and a shorter inner wall 46 depending from the upper portion 28 and disposed within and substantially parallel to the outer wall 44. The outer wall 44 and inner wall 46 form a groove 48 in which a non-slip ring 50 made of a non-slip material, such as rubber or a thermoplastic rubber sold by Advanced Elastomer Systems under the tradename Santoprene, is placed.

The non-slip ring 50 is deformable and has a normal, or non-deformed, width slightly greater than the distance between the outer wall 44 and the inner wall 46. The ring 50 forms a friction fit with the groove 48 to remain in place.

As is discussed more fully below, the first and second sidewalls 24, 26 are designed to be flexible and resilient and can be molded one-piece members made out of a plastic material such as ABS. As seen in FIGS. 8–11, the first sidewall 24 and second sidewall 26, respectively, have proximal ends 52, 54, distal ends 56, 58, interior surfaces 60, 62, exterior surfaces 64, 66, substantially planar portions 68, 69, arcuate-shaped lower portions 70, 71 and sets of substantially coplanar contact surfaces 72, 73, with each set including four such contact surfaces.

The first sidewall 24 also includes a handle knob 74, as seen in FIGS. 2 and 11, for a user to grasp. The knob 74 projects outwardly from the exterior surface 64. As best seen in FIG. 11, to provide a good grip, a non-slip material 75, made of the same or similar material which makes up the non-slip ring 50, can cover the knob 74.

The first sidewall 24 also forms a U-shaped aperture 76 at the distal end 56. Six ribs 78A–F project from the planar portion 68 of the first sidewall 24, ribs 78A–C being located on one side of the U-shaped aperture 76 and ribs 78D–F being located on the other side of the U-shaped aperture 76.

Figure 8:
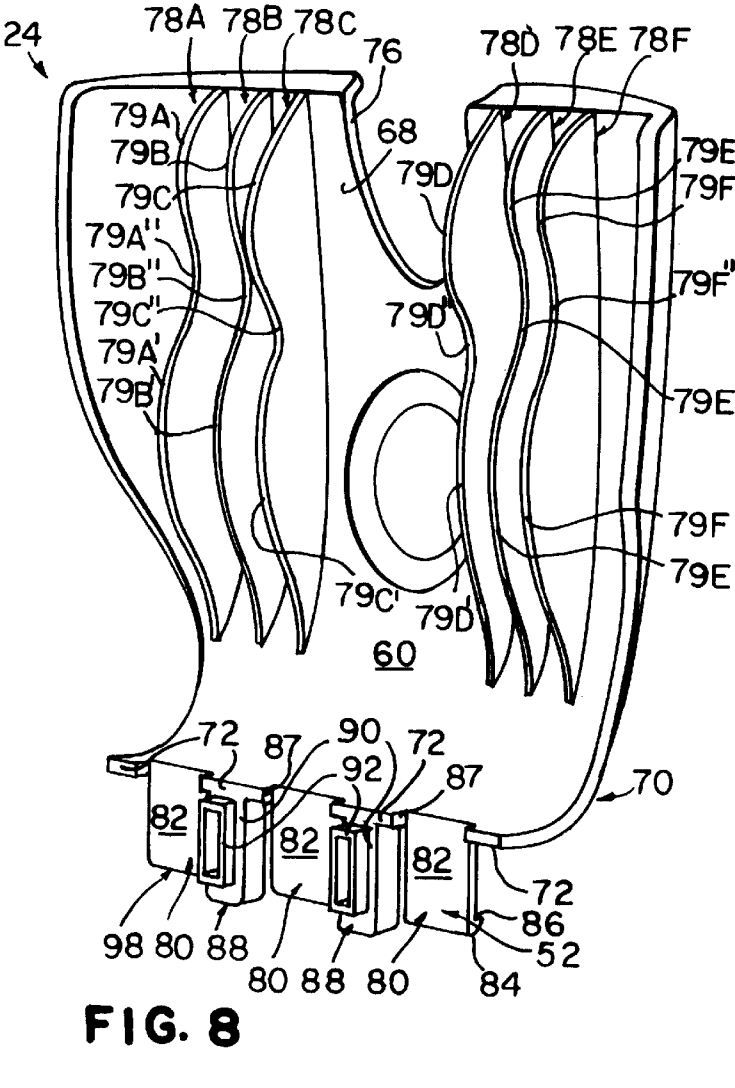
FIG. 8 is an enlarged perspective view of the inner surface of the first sidewall of the holder of FIG. 1.

As seen in FIG. 8, each of the ribs 78A–F has a wave-like shape, and the ribs 78A–F, respectively, have upper wave portions 79A–F and lower wave portions 79A'–F' separated by central portions 79A"–F". The upper wave portions 79A–F and lower wave portions 79A'–F' project outwardly from the interior surface 60 a greater distance than the central portion 79A"–F".

Figure 5A:
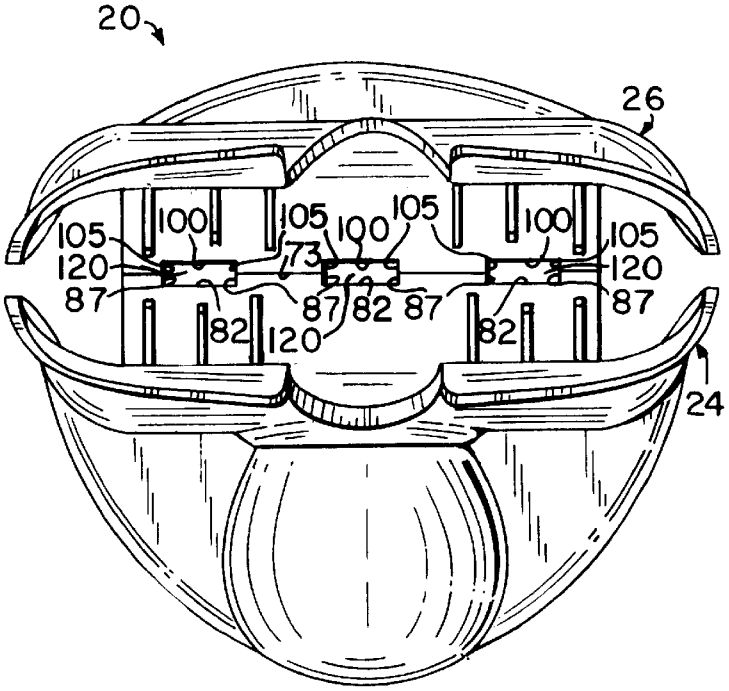
FIG. 5A is a top plan view of the holder of FIG. 5 with the cut mat removed.

The first sidewall 24 also includes, as seen in FIG. 8, three locking clips 80 at the proximal end 52 and projecting downwardly from the arcuate-shaped portion 70. The locking clips 80 each have a planar portion 82 and a lip 84 projecting outwardly from the distal end of the planar portion 82 and sloping upwardly and outwardly to form a shoulder surface 86. As seen in FIGS. 5A and 8, each of the planar portions 82 is offset from the adjacent contact surfaces 72 for cooperation therewith to define walls 87.

The first sidewall 24 also has two pegs 88 depending from the arcuate-shaped portion 70. Each of the pegs 88, as best seen in FIG. 8, is box-like and have a planar portion 90 and a box-like male connector 92 projecting from the planar portion 90.

Figure 5:
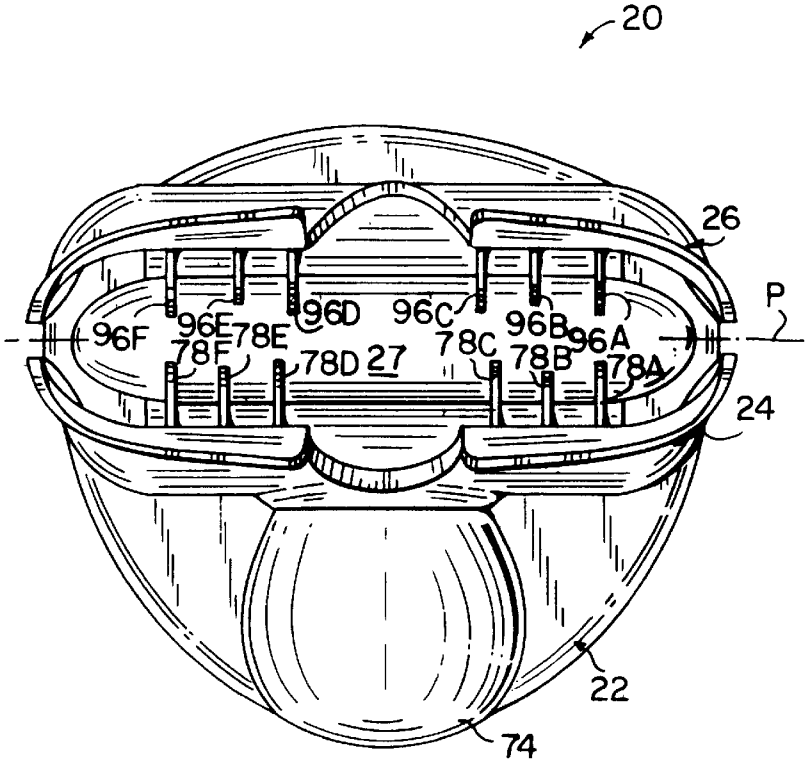
FIG. 5 is a top plan view of the holder of FIG. 1 illustrating the sidewalls in their normal rest position.
Figure 7:
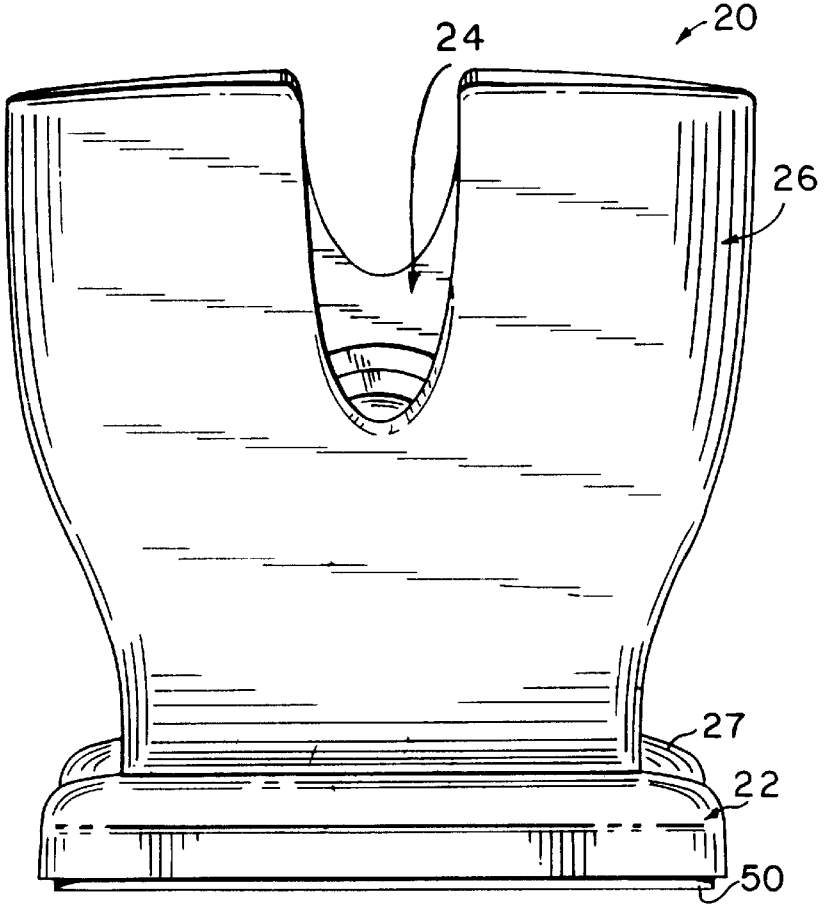
FIG. 7 is a rear elevation view of the holder of FIG. 1.
Figure 9:
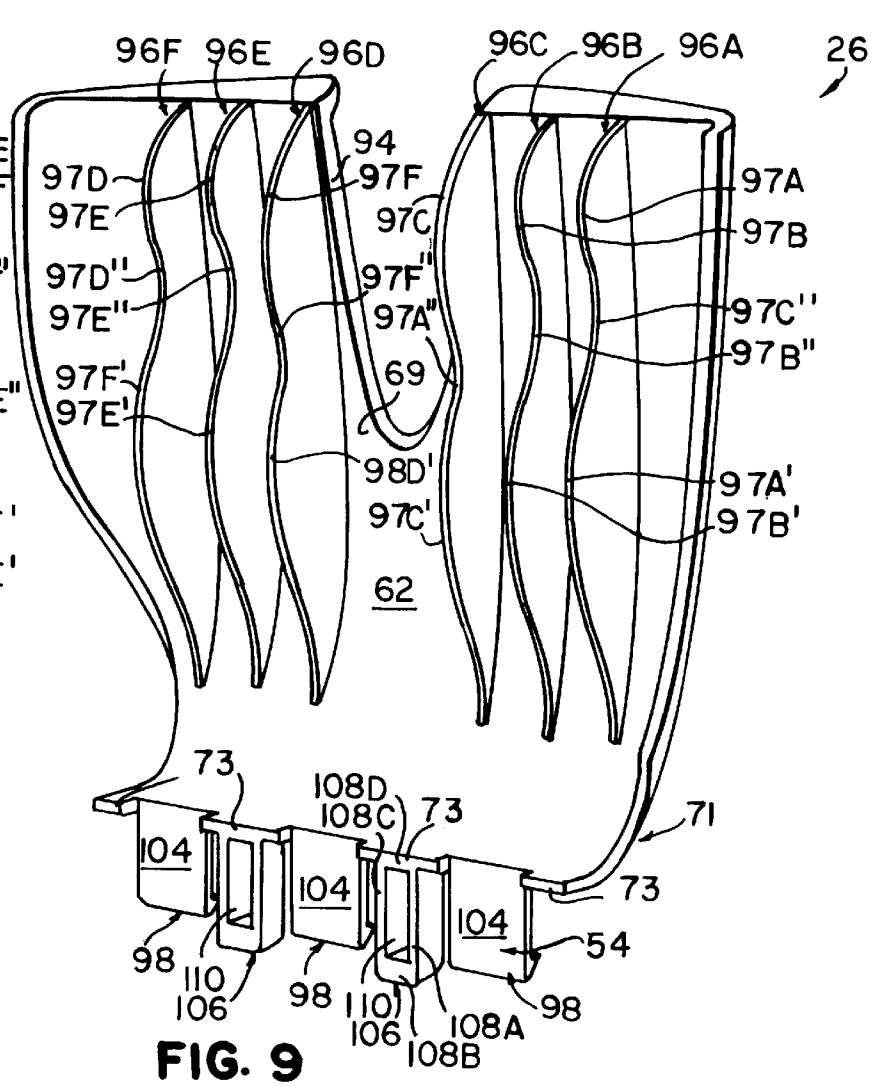
FIG. 9 is an enlarged perspective view of the inner surface of the second sidewall of the holder of FIG. 1.

As seen in FIG. 9, the second sidewall 26 also forms a U-shaped aperture 94 at the distal end 58, slightly deeper than U-shaped aperture 76. Six ribs 96A–F project from the planar portion 69 of the second sidewall 26, ribs 96A–C being located on one side of the U-shaped aperture 94 and ribs 96D–F being located on the other side of the U-shaped aperture 94. When the holder 20 is assembled, the ribs 78A–F respectively project toward or face ribs 96A–F (see FIG. 5) and the minimum distance between facing ones of the ribs 78A–F and 96A–F is less than the thickness of the food item to be sliced.

As seen in FIG. 9, each of the ribs 96A–F has a wave-like shape, and the ribs 96A–F, respectively, have upper wave portions 97A–F and lower wave portions 97A'–F' separated by central portions 97A"–F". The upper wave portions 97A–F and lower wave portions 97A'–F' project outwardly from the interior surface 62 a greater distance than the central portion 97A"–F".

Referring to FIGS. 9 and 11, the second sidewall 26 also includes three locking clips 98 at the proximal end 54 projecting downwardly from the arcuate-shaped portion 71. The locking clips 98 have a planar portion 100 and a lip 102 projecting outwardly from the distal end of the planar portion 100 and sloping upwardly and outwardly to form a shoulder surface 104. Each of the planar portions 100 is offset from the adjacent contact surface 73 for cooperation therewith to define walls 105.

The second sidewall 26 also has two pegs 106 depending from the arcuate-shaped portion 71. Each of the pegs 106, as best seen in FIG. 9, is box-like and has four walls 108A–D defining a box-like aperture 110 for receiving a corresponding male connector 92.

As seen in FIG. 2, the cut mat 27 has a base 112 having an upper surface 114 and a lower surface 116 and three spaced-apart legs 118 depending from the lower surface 116. The cut mat 27 is preferably made of a material resistant to cutting, such as polyethylene.

The holder 20 is assembled as follows. The male connectors 92 of pegs 88 of the first sidewall 24 are inserted into the apertures 110 of pegs 106 of the second sidewall 26 so that contact surfaces 72 respectively abut contact surfaces 73. The proximal ends 52, 54 of the now two joined sidewalls 24, 26 are then secured to the base 22 by inserting the joined pegs 88, 106 through peg apertures 38 and locking or snap-fitting the clip pairs 80, 98 in the locking apertures 30.

As best seen in FIG. 6, the joined pegs 88, 106 have a length substantially equal to the distance between walls 40 of the peg apertures 38 and a width substantially equal to the distance between walls 42 of the peg aperture 38 so that the joined pegs 88, 106 fit firmly within the peg apertures 38.

The locking clips 80, 98 are flexible and resilient. As best seen in FIGS. 6 and 11, when contact surface 72 abuts contact surface 73, the distance between at least a portion of shoulder surface 86 and at least a portion of respective shoulder surface 104 of each clip pair 80, 98 is greater than the distance between walls 32 of the corresponding locking apertures 30. The flexibility and resilience of the locking clips 80, 98 and the slope of lips 84, 102 allows the locking clips 80, 98 to be deflected inwardly toward each other when they contact the walls 32 forming a portion of the locking aperture 30 to permit the clips 80, 98 to be inserted through the corresponding locking aperture 30 to a locked position, shown in FIG. 11, wherein shoulder surfaces 86 and 104 respectively lie below and abut shoulder surfaces 36 of walls 32 of the locking aperture 30 to fixedly secure or snap-fit the sidewalls 24, 26 to the base 22 in a spaced-apart relation.

As best seen in FIG. 5A, when the locking clips 80, 98 of sidewalls 24, 26 are secured to the base 22, the planar portions 82, 100 and walls 87 and 105 form three auxiliary apertures 120. The legs 118 of the cut mat 27 are then respectively inserted into the auxiliary apertures 120. Each of the legs 118 has a thickness substantially equal to the distance between associated planar portions 82, 100 which form a portion of the corresponding auxiliary aperture 120, whereby the legs 118 tightly fit in the auxiliary aperture 120. The tight fit of the legs 118 prevents pegs 88, 106 from flexing when the sidewalls 24, 26 are flexed open to receive a bagel or other food item.

Figures 12, 13:
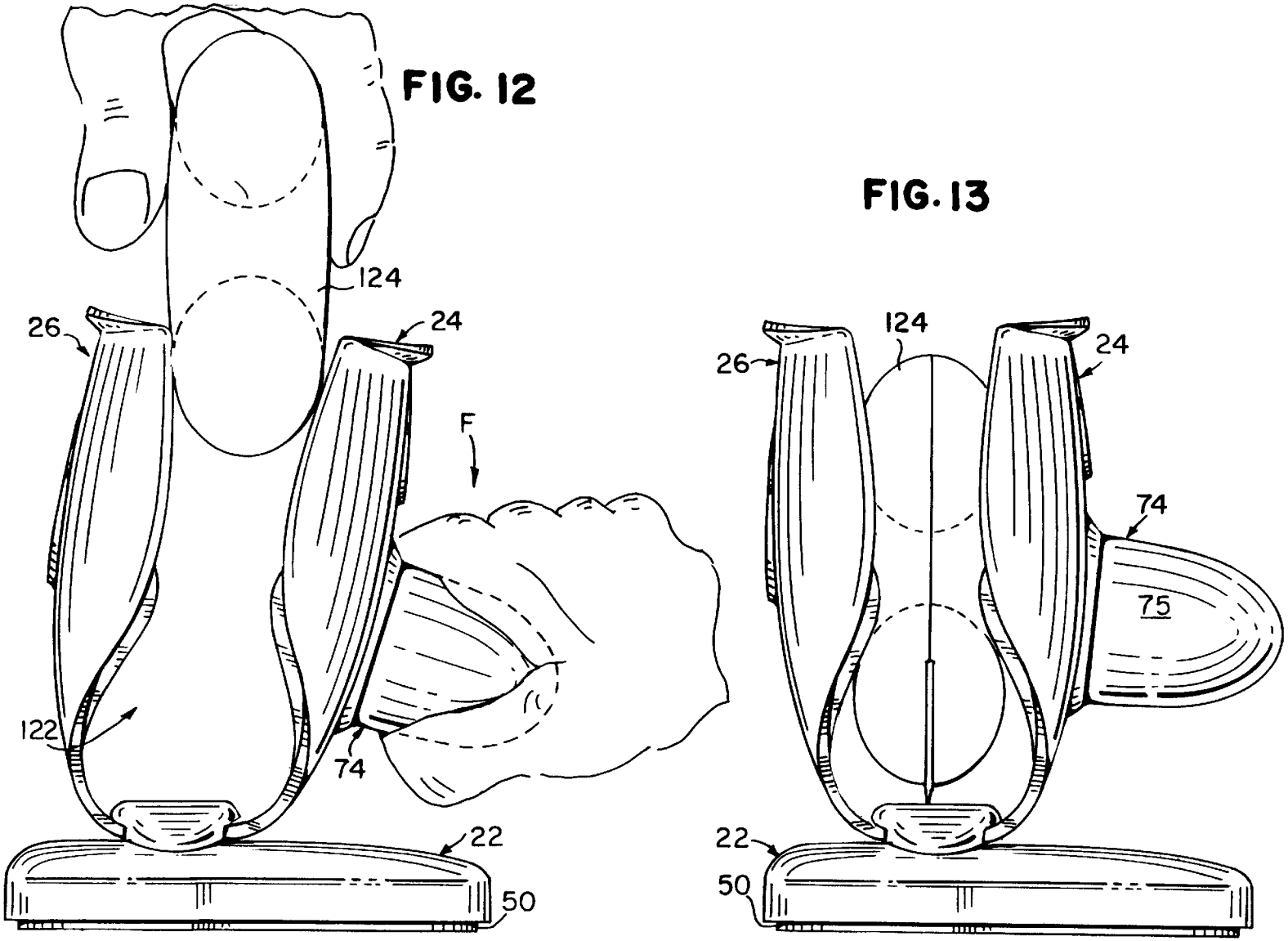
FIG. 12 is a reduced side elevation view of the holder of FIG. 1 as it is being filled.
FIG. 13 is a reduced side elevation view of the holder of FIG. 1 after it has been filled and the sidewalls have been moved from the rest position.

The assembled sidewalls 24, 26 and cut mat 27 form an open compartment 122 for the food item to be sliced. As seen in FIGS. 4, 5, 10 and 11, the sidewalls 24, 26 are in their at-rest position. When a bagel 124 is to be sliced, it is inserted into the top of the compartment 122 by either a user, as seen in FIG. 12, grasping the knob 74 and flexing the associated sidewall 24 in the direction of arrow F, which causes an increase in the distance between the distal ends 56, 58 of the sidewalls 24, 26 and the distance between ribs 78A–F and 96A–F, so that the item to be sliced can be placed between the ribs 78A–F and 96A–F. When, as seen in FIG. 13, the user releases the knob 74, the first sidewall 24, due to its resiliency, moves back toward its at rest position and forces the bagel 124 against the second sidewall 26 to deflect it out of its at rest position. Alternatively, the item can be placed in the top of the compartment 122 contacting the ribs 78A–F and 96A–F and then pushed down to cam distal ends 56, 58 apart from one another. In either situation, the resilience of the sidewalls 24, 26 causes them to attempt to return to their at-rest position and causes the ribs 78A–F, 96A–F to tightly grip the bagel 124 to be sliced.

The ribs 78A–F, 96A–F cooperate to form a wavy contour which maintains the bagel 124 within the compartment and aids in safely slicing the bagel 124 without damage to the user or the bagel. As seen best in FIG. 5, an imaginary vertical plane "P" illustrated by dotted line "P" divides the compartment 122 in half. As seen in FIGS. 5, 5A, 8 and 9, the ribs 78A–F and 96A–F are shaped and arranged to guide the bagel 124 into place and to provide the maximum gripping force without damaging the bagel. The upper wave portions 79C–D, 97C–D of center ribs 78C, 78D and 96C, 96D respectively protrude further from interior surfaces 60, 62 than the remainder of the upper wave portions 79A, 79B, 79E, 79F, 96A, 96B, 96E, 96F, and are closest to plane "P". The lower wave portions 79A', 79F', 97A', 97F' of ribs 78A, 78F, 96A, 96F respectively protrude a greater distance from the interior surfaces 60, 62 and are closer to plane "P" than the remainder of the lower wave portions 78B'–E', 97B'–E' to prevent the bagel 124 from sliding out of the compartment 122. The lower wave portions 79C', 79D', 97C', 97D' of center ribs 78C, 78D, 97C, 97D, do not protrude as far as their associated upper wave portions 79C, 79D, 97C, 97D because, if so constructed, the center ribs 78C, 78D, 97C, 97D might apply too much force on the thickest part of the bagel, thus damaging it. The irregular, wavy contour of the ribs 78A–F, 96A–F increases the grip on an irregular shaped bagel and aids in holding the bagel within the compartment. It is believed that, without this wavy contour, the holder 20 would tend to push the bagel 124 up and out of the compartment 122.

As seen in FIG. 1, a user can grasp a knife 126 with one hand and the knob 74 with the other hand, so that the other hand is separated from the knife blade by the first sidewall 24, and can then safely cut the item to be sliced. The non-slip ring 50 aids in preventing the holder 20 from moving during the slicing operation.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A holder for containing items to be sliced comprising:

a base;

a discrete first sidewall having a proximal end fixedly secured to the base and a distal end;

a discrete second sidewall having a proximal end fixedly secured to the base and a distal end;

the sidewalls having a normal rest position wherein the distal ends are spaced apart a predetermined distance; and each of the sidewalls being formed of a flexible and resilient material and having a first portion adjacent the base and a second portion extending above the base, the second portion inclined with respect to the first portion, the sidewall being flexible adjacent to the base to permit deflection of the sidewall independent of the other sidewall from the rest position toward a deflected position which increases the distance between the distal ends and biased toward the rest position to strongly grip an item to be sliced disposed between the first and second sidewalls.

2. The holder of claim 1, wherein at least one sidewall includes a handle.

3. The holder of claim 1, and further comprising a cut mat secured to the base and disposed adjacent to the first and second proximal ends.

4. The holder of claim 1, wherein the distal end of the first sidewall has a first interior surface and a plurality of first ribs projecting from the first interior surface and the second sidewall has a second interior surface and a plurality of second ribs projecting from the second interior surface and respectively facing the first ribs for cooperation to hold the item to be sliced therebetween.

5. The holder of claim 4, wherein the distance between at least one of the first ribs and at least one of the second ribs is less than the thickness of the item to be sliced.

6. The holder of claim 1, wherein the base has a locking aperture therein and the first and second sidewalls cooperate to define a connector shaped and dimensioned to be snap-fitted in the locking aperture.

7. The holder of claim 6, wherein the first and second sidewalls respectively include first and second locking clips which cooperate to define the connector.

8. The holder of claim 1, wherein the base includes a locking aperture defined in part by a pair of walls having lower shoulder surfaces and the proximal ends of the first and second sidewalls respectively have first and second abutting contact surfaces and first and second locking clips respectively having first and second shoulders, the first and second locking clips being disposed through the locking aperture with the first and second shoulders respectively in contact with lower shoulder surfaces on the clips to releasably secure the first and second sidewalls to the base.

9. The holder of claim 8, and further comprising a cut mat having a cutting base and a leg projecting from the cutting base, wherein the first and second locking clips cooperate to define at least a portion of an auxiliary locking aperture, the leg disposed through the auxiliary locking aperture to secure the cut mat to the base.

10. The holder of claim 8, wherein the base includes a peg aperture and the proximal end of the first sidewall includes a male peg and the proximal end of the second sidewall includes a female peg, wherein a portion of the male peg is disposed in the female peg to form a peg connection disposed in the peg aperture.

11. The holder of claim 1, wherein the base has a top surface and a bottom surface, and further comprising a non-slip material coupled to the bottom surface.

12. The holder of claim 11, wherein the non-slip material is santoprene.

13. A holder for containing items to be sliced comprising:

a base;

a first sidewall having a proximal end fixedly secured to the base and a distal end;

a second sidewall having a proximal end fixedly secured to the base and a distal end;

the sidewalls having a normal rest position wherein the distal ends are spaced apart a predetermined distance; and at least one of the sidewalls being formed of a flexible and resilient material and being deflectable from the rest position in a direction which increases the distance between the distal ends, wherein the distal end of the first sidewall has a first interior surface and a plurality of first ribs projecting from the first interior surface and the second sidewall has a second interior surface and a plurality of second ribs projecting from the second interior surface and respectively facing the first ribs for cooperation to hold the item to be sliced therebetween, wherein each of the first ribs has an upper wave portion, a lower wave portion and a central portion projecting a smaller distance from the first interior surface than both the upper or lower wave portion, and each of the second ribs has an upper wave portion, a lower wave portion and a central portion projecting a smaller distance from the second interior surface than both the upper or lower wave portion.

14. The holder of claim 13, wherein the first ribs include two central ribs and two outer ribs, wherein the upper wave portions of the two central ribs project a greater distance from the first interior surface than the remainder of the upper wave portions of the first ribs, and the second ribs include two central ribs and two outer ribs, wherein the upper wave portions of the two central ribs project a greater distance from the second interior surface than the remainder of the upper wave portions of the second ribs.

15. The holder of claim 14, wherein the lower wave portions of the outer ribs of the first ribs project a greater distance from the first interior surface than the remainder of the lower wave portions of the first ribs, and the lower wave portions of the outer ribs of the second ribs project a greater distance from the second interior surface than the remainder of the lower wave portions of the second ribs.

16. The holder of claim 14, wherein the first and second interior surfaces define a compartment, and the upper wave portions of the central ribs of the first ribs are closer to an imaginary vertical plane which divides the compartment in half than the remainder of the upper wave portions of the first ribs, and the central wave portions of the outer ribs of the second ribs are closer to the imaginary vertical plane than the remainder of the upper wave portions of the second ribs.

17. The holder of claim 14, wherein the first and second interior surfaces define a compartment, and the lower wave portions of the outer ribs of the first ribs are closer to an imaginary vertical plane which divides the compartment in half than the remainder of the lower wave portions of the first ribs, and the lower wave portions of the outer ribs of the second ribs are closer to the imaginary vertical plane than the remainder of the lower wave portions of the second ribs.

18. A holder for containing items to be sliced comprising:

a base;

a first sidewall having a proximal end fixedly secured to the base and a free distal end and having a first interior surface;

a second sidewall having a proximal end fixedly secured to the base and a free distal end and having a second interior surface facing the first interior surface;

the sidewalls having a normal rest position wherein the distal ends are spaced apart a predetermined distance, the first and second sidewalls cooperating to form an open-topped slotted compartment having a food entry defined by the first and second distal ends, wherein in the rest position the distance between the first and second sidewalls at a first location near the food entry is less than the distance between the first and second sidewalls at a second location remote from the food entry; and at least one of the sidewalls being formed of a flexible and resilient material and being deflectable from the rest position in a direction which increases the distance between the distal ends.

19. The holder of claim 18, wherein each of the sidewalls is formed of a flexible and resilient material and is deflectable from the rest position in a direction which increases the distance between the distal ends.

20. The holder of claim 19, wherein the distal end of the first sidewall has a first interior surface and a plurality of first ribs projecting from the first interior surface and the second sidewall has a second interior surface and a plurality of second ribs projecting from the second interior surface and respectively facing the first ribs for cooperation to hold the item to be sliced therebetween.

* * * * *